United States Patent [19]

Parquet et al.

[11] 3,987,920

[45] Oct. 26, 1976

[54] SELF-LEVELING SYSTEM FOR MATERIAL HANDLING IMPLEMENT

[75] Inventors: Donald J. Parquet, Burlington; Marvin L. Brown, West Burlington; Carl O. Pedersen, Burlington, all of Iowa

[73] Assignee: J. I. Case Company, Racine, Wis.

[22] Filed: June 23, 1975

[21] Appl. No.: 589,439

[52] U.S. Cl. ..... 214/763; 91/411 R

[51] Int. Cl.[2] ..... E02F 3/87

[58] Field of Search ..... 214/763, 769, 771; 91/411 R, 414

[56] References Cited

UNITED STATES PATENTS

| | | | |
|---|---|---|---|
| 2,988,891 | 6/1961 | Hemings | 214/771 |
| 3,175,580 | 3/1965 | Krehbiel | 214/771 |
| 3,563,137 | 2/1971 | Graber | 214/763 |

*Primary Examiner*—Robert G. Sheridan
*Assistant Examiner*—Ross Weaver
*Attorney, Agent, or Firm*—Dressler, Goldsmith, Clement, Gordon & Shore, Ltd.

[57] ABSTRACT

A self-leveling system for a material handling unit on a pivoted boom is disclosed herein. The self-leveling system consists of a separate valve which is automatically controlled by the actuation of a material handling valve to produce the leveling function in either the raising or lowering condition for the boom.

10 Claims, 4 Drawing Figures

40
70
72
66
64
62
60
58
56
54
52
50
48
42
74
104
140
156
149
150
148
146
144
142
154
152
158
138
112
110
108
106
130
132
136
105
100
3
4

30
44
66
72
42
150
148
160a
161
160

34
70
126
128
124
122
54
44
42
110

SELF-LEVELING SYSTEM FOR MATERIAL HANDLING IMPLEMENT

BACKGROUND OF THE INVENTION

The present invention is related to earthworking implements and more particularly to an automatic control for positioning the bucket on the outer end of a boom that is pivotally supported on a vehicle.

Earthworking implements, commonly referred to as front end loaders, have been in existence for many years. These units consist of a vehicle that has a pair of lift arms defining a boom pivoted thereon with a material handling implement pivoted on the outer end of the boom. The pivotal movement of both the boom and material handling unit is controlled by fluid rams.

One of the problems encountered with loaders of this type is the danger in having the material handling unit tilt towards the vehicle during the elevation of the boom and consequently the possibility of spilling the contents onto the operator is a serious hazard. Numerous solutions to this problem have been proposed. Prior attempts to solve this problem included self-leveling means in the form of a linkage between the lift arms and the booms. While various types of linkages have been suggested for solving this problem, linkages have a serious shortcoming in that there is no way in which the effect of the linkage can be manually interrupted.

To overcome this shortcoming, various types of hydraulic self-leveling systems have been proposed. For example, one type of system incorporates additional slave fluid rams which are connected to the bucket tilt fluid rams to automatically supply fluid during the raising and lowering operation. These slave fluid rams are interposed between the vehicle and the boom. Again, no provision is made for interrupting the leveling function by the operator.

In more recent years, other types of hydraulic leveling systems have been proposed. These systems normally include a single complicated valve housing which incorporates the valves for operating the boom rams and bucket rams as well as an interconnection between the two to produce the leveling function. Again, such units do not normally include provisions for allowing the operator to interrupt the leveling function, when desired.

SUMMARY OF THE INVENTION

According to the present invention, a separate leveling valve is incorporated into the hydraulic circuit for controlling a boom and a material handling unit on the outer end of the boom. The leveling valve directs return flow from the boom ram to the unit ram during both raising and lowering of the boom to maintain a material handling unit at a predetermined angle with respect to a reference plane. The leveling valve also has flow divider means therein for controlling the amount of flow that is directed to the unit ram from the boom ram.

The hydraulic circuit also incorporates a pilot valve means for automatically rendering the leveling valve means inoperative whenever the unit valve means is operated.

DETAILED DESCRIPTION

Figure 1:
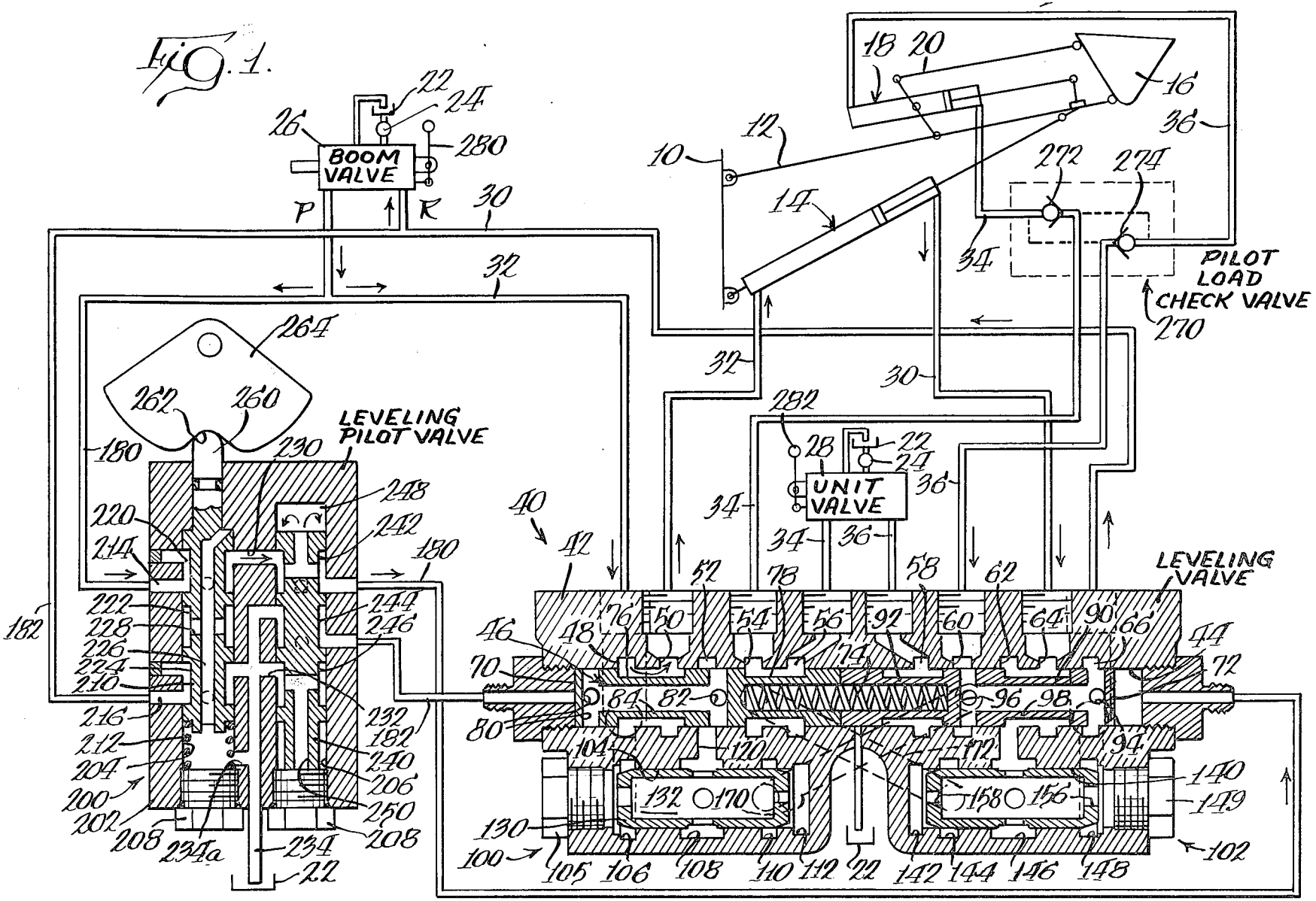
FIG. 1 schematically illustrates a material handling vehicle and a hydraulic circuit for the fluid rams that form part of the material handling vehicle.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIG. 1 of the drawings schematically discloses a material handling vehicle and a hydraulic circuit for controlling the operating functions of the material handling vehicle. In FIG. 1, the vehicle itself is schematically indicated as a fixed support 10 pivotally supporting a boom 12 thereon. Boom 12 is pivoted or raised and lowered with respect to vehicle 10 through a boom ram 14 interposed between vehicle 10 and the outer end of the boom.

A material handling unit 16, such as a bucket, is pivotally supported on the outer end of the boom and the pivotal movement of bucket 16 on the outer end of boom 12 is accomplished through a unit fluid ram 18 connected to bucket 16 and boom 12 through a linkage 20.

Hydraulic fluid for rams 14 and 18 is supplied from a reservoir 22 through a hydraulic circuit which is also illustrated in FIG. 1. The hydraulic circuit incorporates pump means 24 for supplying fluid under pressure from reservoir 22 to boom valve means 26 and unit valve means 28. Boom valve means 26 is connected to opposite ends of the cylinder, which forms part of boom ram 14, through conduits 30 and 32 which define boom conduit means. Likewise, unit valve means 28 is connected to opposite ends of the cylinder forming part of unit ram 18 through conduits 34 and 36 which define unit conduit means.

With the hydraulic system so far described, actuation of the boom valve means 26 in opposite directions will connect pump means 24 with one end of fluid ram 14 through one of conduits 30, 32 while the opposite end is connected to reservoir 22 through the other of conduits 30, 32. Also, actuation of unit valve means 28 in opposite directions from a neutral position, will connect one of conduits 34, 36 to pump means 24 while the other of conduits 34, 36 is connected to reservoir 22 to extend or retract fluid ram 18. Since this is accomplished with conventional well known valve means, a detailed description of the two valve means does not appear to be necessary.

As indicated above, in many instances it is desirable to maintain a predetermined attitude of the material handling unit 16 with respect to a reference plane during both raising as well as lowering of the boom with respect to the vehicle. According to the present invention, this is accomplished by a unique leveling valve means which is normally automatically actuated in response to actuation of the boom valve means and is automatically excluded from the hydraulic circuit when the bucket valve means is actuated. All of this is accomplished in a separate valve means so that conventional boom and unit valve means may be utilized in the hydraulic circuit.

Referring to FIG. 1 of the drawings, it will be noted that leveling valve means 40 is located in boom conduit means 30, 32 and unit conduit means 34, 36. Leveling valve means 40 includes a valve housing 42 having an axial bore 44 therein with valve spool means 46 slidable within bore 44. Valve bore 44 has a plurality of enlarged recesses 48–66 at axially spaced locations along the length of the bore.

The respective recesses are positioned and interconnected in such a manner that movement of the spool means 46 within axial bore 44, will automatically interconnect selected conduits associated with the recesses to produce a self-leveling function. More specifically, recesses 48 and 50 at one end of bore 44 are respectively connected to conduit 32 while recesses 64 and 66 at the opposite end of bore 44 are respectively connected to conduit 30. Two adjacent recesses 54 and 56 are connected to conduit 34, which forms part of unit conduit means, while recesses 58 and 60 are connected to conduit 36, which also forms part of the unit conduit means.

According to one aspect of the invention, valve spool means 46 consists of first and second valve spool sections 70 and 72 which are independently slidable within valve bore 44 and have spring biasing means 74 interposed therebetween to normally hold the respective sections in a first position, that will be described in more detail later. Valve spool section 70 has two axially spaced circumferential grooves 76 and 78 intermediate opposite ends thereof. Valve spool 70 also has a first pair of cross drilled holes 80 adjacent one end of the spool and a second pair of cross drilled holes 82 interconnected by an axial opening 84.

Likewise, valve spool section 72 has axially spaced annular grooves 90 and 92 and a first set of cross drilled holes 94 and a second set of cross drilled holes 96 interconnected by axial opening 98.

Leveling valve means 40 also incorporates flow divider means for dividing the return flow from boom ram 14 between unit ram 18 and reservoir 22, as will be described in more detail later. Again, the flow divider means consists of first and second flow dividers 100 and 102 that respectively are associated with first and second spool sections 70 and 72.

Flow divider section 100 consists of an elongated bore 104 defined in valve housing 42 and closed at one end by plug 105 with axially spaced enlarged recesses 106, 108, 110 and 112 on bore 104. Intermediate recess 108 is in communication with recess 52 on bore 44 through passage 120.

Figure 3:
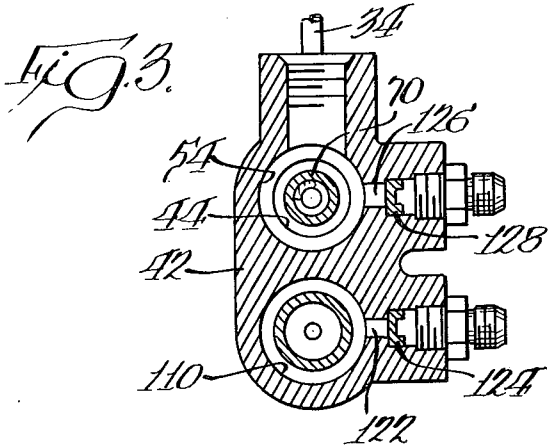
FIG. 3 is a sectional view, as viewed along line 3—3 of FIG. 2.

Referring particularly to FIG. 3 of the drawings, it will be noted that recess 110 is in communication with the periphery of valve housing 42 through a passage 122 which has a restricted orifice 124 therein. Also, enlarged recess 106 is in communication with the boom conduit means in a manner that will be described in connection with flow divider 102. Furthermore, enlarged recess 54 of valve bore 44 is likewise in communication with the periphery of valve housing 42 through a passage 126 having a restricted orifice 128 therein.

Flow divider 100 also has a hollow flow divider element 130 supported for slidable movement within bore 104. Flow divider element 130 is hollow internally to define an elongated opening 132 which is at all times in communication with enlarged recess 108 through openings 134. Also, opposite ends of opening 132 are respectively in communication with opposite ends of bore 104 through restricted orifices 136 and 138 and the flow divider spool is free to move axially in bore 104.

Second flow divider 102 is identical in construction to first flow divider 100 and consists of a bore 140 located in valve housing 42 with axially spaced enlarged recesses 142, 144, 146 and 148 defined on bore 140. The open end of bore 140 is closed by a plug 149. Valve bore 140 slidably supports a hollow sleeve 150 which has an internal opening 152 in continuous communication with enlarged recess 146 through openings 154. The opposite ends of opening 152 are respectively in communication with opposite ends of bore 140 through orifices 156 and 158.

Figure 4:
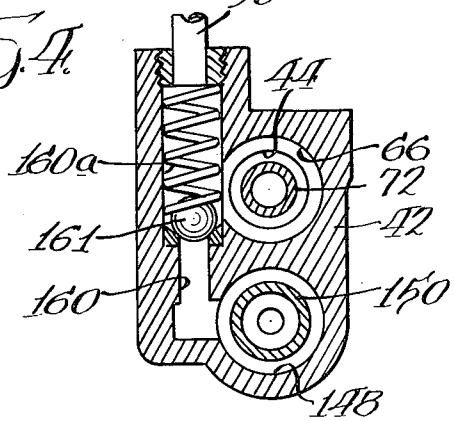
FIG. 4 is a sectional view of the leveling valve as viewed along line 4—4 of FIG. 2.

Referring to FIG. 4, it will be noted that enlarged recess 148 is in communication with a passage 160 in housing 42 and passage 160 has an enlarged portion **160*a* which is also in communication with enlarged recess 66 of valve bore 44 and is connected to conduit 30. A unidirectional check valve 161 is located in enlarged portion 160*a* which prevents flow of fluid from conduit 30 to enlarged recess 148,** for a purpose that will be described later.

As shown in FIG. 1, enlarged recess 110 of flow divider 100 is connected to enlarged recess 60 of bore 44 through an external conduit 170 while enlarged recess 144 of flow divider 102 is connected to enlarged recess 54 of bore 44 through an external conduit 172.

According to one important aspect of the present invention, the movement of valve spool sections 70 and 72 to provide automatic leveling is automatically provided by the flow of fluid in boom conduit means 30 and 32. For this purpose, boom valve means 26, more specifically conduits 30 and 32 are connected to opposite ends of elongated bore 44 through conduits 180 and 182 (FIG. 1). Conduits 180 and 182 incorporate a manually operated pilot valve means 200, which when actuated, automatically interrupts flow of fluid through conduits 180 and 182. Pilot valve means 200 consists of a valve housing 202 having a pair of spaced bores 204 and 206 extending from one end of housing 200 and closed by plugs 208. Bore 204 has a valve spool 210 slidable therein and normally biased to a first position by a spring 212. Conduit 180 is in communication with bore 204 through a passage 214 while conduit 182 is in communication with bore 204 through a passage 216. Valve spool 210 also has three axially spaced circumferential grooves 220, 222 and 224 and an axial bore 226. Bore 226 is in communication with groove 222 through openings 228.

Valve spool 210 also has a valve stem 260 extending through the periphery of housing 202 and biased into engagement with a camming surface 262 on cam member 264 by spring 212. Cam member 264 is preferably rotated in response to actuation of unit valve means 28 in either direction from the neutral position.

Valve housing 202 also has a pair of passages 230 and 232 interconnecting bores 204 and 206, while a third passage 234 connects an intermediate portion of bore 206 with reservoir 22. Second bore 206 has a valve spool 240 slidable therein and this spool has three axially spaced recesses 242, 244 and 246. Spool 240 also has axially extending openings 248 and 250 extending from opposite ends of the valve spool with the inner ends of the openings respectively being in communication with recesses 242 and 246.

The hydraulic circuit also incorporates pressure responsive check valve means 270 located in boom conduit means 34 and 36. Check valve means 270 consists of first and second unidirectional check valves 272 and 274 respectively located in conduits 34 and 36. Pressure responsive check valve 272 is open in response to pressure in conduit 36 while pressure responsive check valve 274 is opened in response to pressure in conduit 34, for a purpose that will be described later.

Operation

The valve spools for boom valve means 26 and unit valve means 28 are controlled by the operator through manual control levers 280 and 282 which are movable in opposite directions from a central neutral position to supply fluid under pressure through the respective conduit means.

Assuming that the unit valve means 28 is in neutral condition and boom valve means is in a condition for raising boom 12 with respect to vehicle 10. In this position, fluid under pressure from pump means 24 is supplied to conduit 32 and is delivered to the head end of the cylinder of boom ram 14 through enlarged recess 48, circumferential groove 76, and enlarged recess 50. At the same time, pressurized fluid in conduit 32 passes through conduit 180, through pilot valve means 200 via passage 214, annular groove 220, passage 230 and annular groove 242 to the right-hand end of bore 44 of leveling valve means 40. This fluid under pressure is also delivered to the upper end of bore 206 to insure that valve spool 240 is maintained in the position illustrated in FIG. 1 of the drawings.

The pressurized fluid in bore 44, (the right-hand side in FIG. 1) will overcome the bias of spring 74 and move spool section 72 to the second position illustrated in FIG. 1. In this second position, the return flow of fluid from unit ram 14 through conduit 30 passes from enlarged recess 64 through annular groove 90 into the center opening 152 of flow divider spool 150. The fluid received into the center of the hollow spool 150 must pass through either orifice 156 or orifice 158 and the relative sizes of the two orifices will determine the position of the hollow flow divider spool 150. This can be seen from FIG. 1, where the flow of fluid to the respective orifices 156 and 158 that passes into opposite ends of the closed bore can only escape through restricted orifices defined between spool 150 and bore 140. The fluid that passes between spool 150 and bore 140 at the right-hand end of spool 150 is returned to the reservoir through passage 156 and conduit 30 by the opening of check valve 161. The remainder of the fluid which passes through the restricted orifice between valve bore 140 and valve spool 150 at the left-hand end of spool 150 is received into enlarged recess 144, passes through conduit 172 into enlarged recess 54 on bore 44 and through conduit 34 to the rod end of the cylinder of fluid ram 18 to pivot bucket 16 in a clockwise direction on boom 12.

The pressurized fluid passing through conduit 34 forces fluid from the cylinder of bucket ram 18 through conduit 36 into recess 60 through axial opening 98 in spool section 72 and is returned to the reservoir through return conduit 30 and boom valve 26.

It should be noted at this point that pressure responsive check valve means or dual pilot operated load check valve 270 acts to prevent overtravel of the material handling unit 16 in the clockwise direction. For example, if a bucket is heavily loaded, there may be a tendency for the weight of the material in the bucket to cause a greater clockwise movement than the amount of fluid through conduit 34 would dictate. In such situation, the drop of pressure of the fluid in conduit 34 would automatically cause check valve 274 to close and prevent flow of fluid through conduit 36.

Figure 2:
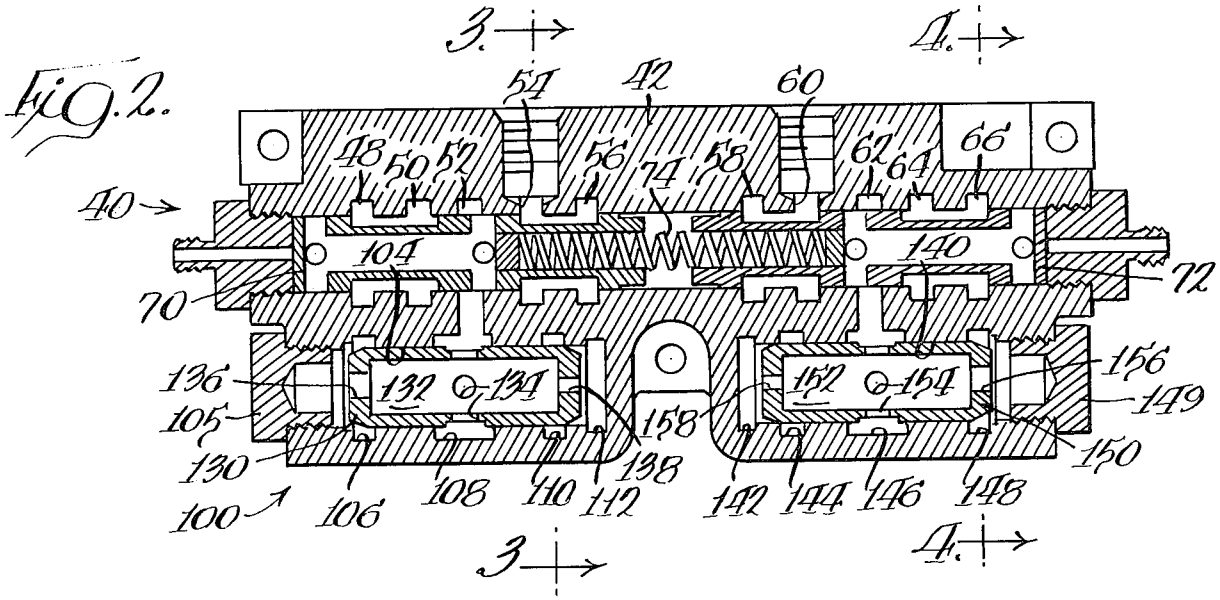
FIG. 2 is a cross-sectional view of the leveling valve.

If the operator actuates unit valve means 28 while boom valve means is in the position described above, the leveling function of the hydraulic circuit is automatically interrupted so that the position of material handling unit 16 is under the exclusive control of unit valve means 28. Movement of control lever 282 to actuate unit valve means 28, will automatically rotate cam 264 and will move pilot valve spool 210 to a second position, wherein the flow of fluid across valve bore 204 from conduit 180 is interrupted and both ends of leveling valve bore 44 are connected to reservoir 22. Stated another way, when pilot valve spool 210 is moved downward, passage 230 and 232 are both connected to axial bore 226 in valve spool 210. Thus, fluid that is under pressure in either end of bore 44 will flow through conduits 180 or 182 to the lower end of bore 204 and into reservoir 22 through passage 234 and **234*a*. With release of the pressure of fluid in conduit 180, spring 74 automatically moves valve spool section 72 to its first position shown in FIG. 2 wherein enlarged recess 64 is connected to enlarged recess 66 through annular groove 90 in valve spool section 72 so that all of the return fluid from the cylinder of boom ram 14 is returned to the reservoir through conduit 30. At the same time, unit valve means 28 is connected to the head end of the cylinder of boom ram 18 through enlarged recesses 58 and 60 and annular groove 92 in valve spool section 72.**

Considering now the operation of the self-leveling valve during the lowering of the boom, pressurized fluid will be delivered through conduit 30, enlarged recess 66, annular groove 90 and enlarged recess 64 to the rod end of the cylinder of boom ram 14. This will lower the boom with respect to vehicle 10. At the same time, the pressurized fluid in conduit 30 is delivered to pilot valve means 200 through conduit 182. This pressurized fluid flows through passage 216, annular groove 224, passage 232 and axial bore 250 to move the valve spool 240 to a raised position and connect passage 232 with the left-hand end of bore 44 of leveling valve means 40. This will cause spool section 70 to be moved from a first position to a second position wherein the return fluid from the head end of the cylinder of boom ram 14 passes through enlarged recess 50, annular groove 76 and passage 120 into flow divider 100. Again, as described above, flow divider 100 divides the return flow so that a portion passes through center portion 132, orifice 138, enlarged recesses 112 and 110, to conduit 36 via conduit 170 to move the material handling unit or bucket 16 in a counterclockwise direction with respect to boom 12. The fluid that passes through orifice 136 is received into recess 106 and is returned to the reservoir through conduit 32. The return fluid from unit ram 18 passes through conduit 34, enlarged recess 82, axial passage 84 and enlarged recess 48 through conduit 32 to reservoir 22.

As can be appreciated from the above description, the present invention provides a unique self-leveling system wherein the amount of fluid delivered to the material handling unit ram can accurately be controlled by proper selection of orifice sizes in the flow divider means. This eliminates the need for relative sizing of the boom and material handling unit ram. Furthermore, the leveling system is automatically interrupted at the time the operator actuates the unit valve means so that the operator has more accurate control of the material handling unit. All of this is accomplished with a separate leveling valve means that can readily be incorporated into a part of a hydraulic control circuit which also includes well-known commercially available boom and unit valve means.

What is claimed is:

1. In a vehicle having a boom pivoted thereon; a boom ram for raising and lowering said boom on said vehicle; a material handling unit pivoted on said boom; a unit ram for pivoting said unit on said boom; and a hydraulic circuit for supplying fluid to said rams, said hydraulic circuit including a reservoir; pump means supplying fluid under pressure from said reservoir; boom valve means between said boom ram, reservoir and pump means; unit valve means between said unit ram, reservoir and pump means; boom and unit conduit means respectively connecting said boom valve means to said boom ram and said unit valve means to said unit ram; and leveling valve means in said conduit means metering return flow from said boom ram to said unit ram for automatic leveling of said unit in response to movement of said boom, said leveling valve means including pilot valve means actuated in response to actuation of said unit valve means to prevent flow from said boom ram to said unit ram said leveling valve means further including a valve housing having a valve bore therein, and spool means in said valve bore, further including first and second conduits connecting said boom valve means to opposite ends of said bore with said pilot valve means interrupting flow through said first and second conduits when said unit valve means is actuated.

2. A vehicle as defined in claim 1, in which said spool means includes first and second spool sections respectively slidable in said bore with biasing means between said sections normally maintaining said sections in a first position wherein all fluid from said boom valve means is delivered to said boom ram, said spool sections respectively having second positions for directing return flow from said boom ram to said unit ram in respective directions of movement of said boom ram.

3. A vehicle as defined in claim 2, further including pressure responsive check valve means in said unit conduit means preventing flow when the pressure of fluid to said unit ram is below a certain level.

4. A vehicle as defined in claim 2, in which said leveling valve means has first and second flow dividers respectively between said spool sections and said unit ram for diverting a portion of the return fluid from said boom ram to said reservoir.

5. In a vehicle having a boom pivoted thereon; a boom ram for raising and lowering said boom on said vehicle; a material handling unit pivoted on a free end of said boom; a unit ram between said boom and unit for pivoting said unit on said boom; and a hydraulic circuit including a reservoir and pump means supplying fluid under pressure from said reservoir, said hydraulic circuit including boom valve means; boom conduit means connecting said reservoir and pump means to said boom ram; unit valve means; unit conduit means connecting said reservoir and pump means to said unit ram; leveling valve means in said unit and boom conduit means, said leveling valve means including a housing having a bore therein with spool means slidable in said bore; conduits connecting said boom valve means to opposite ends of said bore for moving said spool means in response to fluid flow through said boom valve means and conditioning said leveling valve means to direct return flow of fluid from said boom ram to said unit ram thereby changing the angular position of said unit relative to said boom during raising and lowering of said boom; and manual pilot valve means in said conduits for interrupting the flow of fluid through said conduits and conditioning said leveling valve means to direct all return flow from said boom ram to said reservoir.

6. A vehicle as defined in claim 5, in which said leveling valve means includes flow divider means for dividing said return flow between said unit ram and said reservoir.

7. A vehicle as defined in claim 5, further including pressure responsive check valve means in said unit conduit means preventing flow of fluid through one conduit of said unit conduit means when the pressure of fluid in another conduit of said unit conduit means drops below a certain level.

8. A vehicle as defined in claim 5, in which said spool means includes first and second spool sections with biasing means between said sections biasing said sections to a first position directing all return flow from said boom ram to said reservoir, said first section being moved to a second position during raising of said boom and said second section being moved to a second position during lowering of said boom to direct return flow from said boom ram to said unit ram.

9. A vehicle as defined in claim 8, in which said pilot valve means is actuated in response to manual actuation of said unit valve means, and connects opposite ends of said bore to said reservoir.

10. A vehicle as defined in claim 8, further including flow divider means between each spool section and said unit ram for dividing return flow from said boom ram between said reservoir and said unit ram.

* * * * *